US010500434B2

(12) United States Patent
Hsieh

(10) Patent No.: US 10,500,434 B2
(45) Date of Patent: Dec. 10, 2019

(54) EXERCISING DEVICE AND OPERATING METHOD THEREOF

(71) Applicant: KUANG YU METAL WORKING CO., LTD., Chang-Hua Hsien (TW)

(72) Inventor: Wen-Hsu Hsieh, Chang-Hua Hsien (TW)

(73) Assignee: KUANG YU METAL WORKING CO., LTD., Chang-Hua Hsien (TW)

( * ) Notice: Subject to any disclaimer, the term of this patent is extended or adjusted under 35 U.S.C. 154(b) by 979 days.

(21) Appl. No.: 14/875,706

(22) Filed: Oct. 6, 2015

(65) Prior Publication Data

US 2016/0236030 A1 Aug. 18, 2016

(30) Foreign Application Priority Data

Feb. 16, 2015 (TW) ..... 104105372 A
Sep. 2, 2015 (TW) ..... 104129031 A

(51) Int. Cl.

| | |
|---|---|
| ***A61H 1/00*** | (2006.01) |
| ***A61H 23/02*** | (2006.01) |
| ***A47C 1/032*** | (2006.01) |
| ***A63B 21/00*** | (2006.01) |

(52) U.S. Cl.

CPC ..... *A63B 21/4027* (2015.10)

(58) Field of Classification Search

CPC .. A61H 1/00; A61H 1/005; A61H 2201/0149; A47C 1/0242; A47C 1/0246; A47C 1/03211; A47C 1/03222; A47C 20/041; A47C 20/042

See application file for complete search history.

(56) References Cited

U.S. PATENT DOCUMENTS 2,226,861 A * 12/1940 Hanson ..... A47C 7/566 297/249
2,696,207 A * 12/1954 Bushnell ..... A61G 7/005 5/609
2,714,922 A * 8/1955 McKibban ..... A47C 1/03211 297/330
2,808,828 A * 10/1957 Rubin ..... A47C 21/006 5/109
2,874,689 A * 2/1959 Gavelek ..... A61H 15/0078 601/116
3,381,997 A * 5/1968 Fritz ..... A47C 1/0242 297/319
3,873,152 A * 3/1975 Garas ..... A47C 1/0242 297/330
4,074,371 A * 2/1978 Lindbloom ..... A47C 17/04 5/13

(Continued)

FOREIGN PATENT DOCUMENTS

CN 2925531 Y 7/2007
CN 201091670 Y 7/2008

(Continued)

*Primary Examiner* — Michael J Tsai
*Assistant Examiner* — Christopher E Miller
(74) *Attorney, Agent, or Firm* — CKC & Partners Co., LLC

(57) ABSTRACT

An exercising device includes a base, a rail, a swinging chair, and a swinging unit. The rail is pivotally disposed at the base by at least one pivoting point. The swinging chair is movably disposed on the rail. The swinging unit is disposed between the rail and the base. The swinging unit is for changing an angle between the rail and the base.

22 Claims, 16 Drawing Sheets

(56) References Cited

U.S. PATENT DOCUMENTS 4,226,468 A * 10/1980 Johnson ..... A47C 1/0347 297/68
4,386,803 A * 6/1983 Gilderbloom ..... A47C 1/022 297/330
4,563,784 A * 1/1986 Shrock ..... A47C 17/17 297/342
4,678,231 A * 7/1987 Chizek ..... A47C 1/0242 297/329
4,696,512 A * 9/1987 Burnett ..... A47C 1/035 297/330
5,348,375 A * 9/1994 Steininger ..... A61G 15/02 297/344.14
5,372,505 A * 12/1994 Smith ..... A61H 1/001 434/67
5,556,163 A * 9/1996 Rogers, III ..... A47C 1/023 297/330
5,790,997 A * 8/1998 Ruehl ..... A47C 17/162 297/316
5,992,931 A * 11/1999 LaPointe ..... A47C 1/0345 297/330
6,158,808 A * 12/2000 Margolis ..... A47C 1/035 297/284.5
6,302,482 B1 * 10/2001 Moll ..... A47C 1/023 297/339
7,578,797 B2 * 8/2009 Hazard ..... A47C 3/0255 297/273
RE43,193 E * 2/2012 Osborne ..... A47C 19/045 5/600
2002/0121803 A1 * 9/2002 Schooler ..... B60N 2/0232 297/330
2002/0163236 A1 * 11/2002 Chen ..... A47C 1/0242 297/330
2004/0230142 A1 11/2004 Park
2005/0052067 A1 * 3/2005 Grimm ..... A47C 1/03211 297/423.2
2006/0238007 A1 * 10/2006 Lin ..... A47C 1/0355 297/330
2007/0207900 A1 9/2007 Huang et al.
2007/0225622 A1 * 9/2007 Huang ..... A61H 1/005 601/30
2007/0259758 A1 * 11/2007 Zeng ..... A61H 1/003 482/79
2007/0299373 A1 * 12/2007 Chen ..... A61H 1/003 601/30
2009/0224578 A1 * 9/2009 Lo ..... A47C 1/035 297/183.4
2009/0247914 A1 * 10/2009 Shen ..... A61H 1/005 601/49
2009/0256402 A1 * 10/2009 Smith ..... A47C 1/0352 297/69
2010/0234197 A1 * 9/2010 Huang ..... A61H 1/005 482/142
2012/0212018 A1 8/2012 Ishikawa et al.
2013/0012849 A1 * 1/2013 Seaton ..... A61H 1/005 601/24
2014/0035395 A1 * 2/2014 Marcantoni ..... A47C 20/041 310/12.27
2014/0070588 A1 * 3/2014 Wittenberg, Jr. .. A47C 1/03211 297/362.11
2014/0103688 A1 * 4/2014 Wilson ..... A47C 1/03211 297/337
2014/0300162 A1 * 10/2014 Udriste ..... B64D 11/06 297/340
2014/0327282 A1 * 11/2014 Crum ..... A47C 1/032 297/259.2
2015/0196123 A1 7/2015 Buehrer
2015/0208805 A1 * 7/2015 Griggs, Jr. ..... A47C 1/0355 297/463.1
2015/0320215 A1 * 11/2015 Flamme ..... A47C 1/0242 297/463.1
2015/0352983 A1 * 12/2015 Cailleteau ..... B60N 2/067 297/340
2017/0128320 A1 * 5/2017 Chen ..... A61H 15/0078

FOREIGN PATENT DOCUMENTS

CN 102599747 A 7/2012
CN 203123445 U 8/2013
CN 203291182 U 11/2013
CN 203370074 U 1/2014
CN 203988893 U 12/2014
CN 204709707 U 10/2015
DE 3638359 A1 9/1988
DE 19801524 A1 7/1999
DE 202008015674 U1 3/2009
DE 102009055700 A1 6/2010
DE 102010050302 A1 5/2012
JP 1987078144 U 5/1987
JP 2010207570 A 9/2010
JP 2012170554 A 9/2012
KR 100942968 B1 2/2010
TW 200808402 A 2/2008
TW M361360 U 7/2009
WO 2014009147 A1 1/2014
WO 2014061843 A1 4/2014
WO 2014082977 A1 6/2014

* cited by examiner

EXERCISING DEVICE AND OPERATING METHOD THEREOF

RELATED APPLICATIONS

This application claims priority to Taiwan Application Serial Number 104105372, filed Feb. 16, 2015 and Taiwan Application Serial Number 104129031, filed Sep. 2, 2015, which is herein incorporated by references.

BACKGROUND

Technical Field

The present disclosure relates to an exercising device. More particularly, the present disclosure relates to an exercising device with swinging function and the operating method thereof.

Description of Related Art

Because of the popularization of health, exercise becomes more and more important for modern people. Besides the outdoor exercise, like running, riding bike, and playing ball, people would like to go to the gym to do the muscle training so as to improve the blood circulating, the metabolism, and the body health. However, the acceptant exercising strength is different from each person and the health status of each person is also different. Therefore, the usage of the exercising device is limited. Some people develop a simple swinging device to decrease the difficulty of exercise and thus everyone can use the device easily.

The conventional swinging device includes a platform and at least one swinging unit for swinging the platform. When people stand on the platform, the human body can swing along with the platform and the muscle in body will be vibrated because of the swinging motion. Thus the exercise effect is achieved. Because there is no complicated step to use the swinging device and the only thing has to do before using is standing on the platform, the swinging device is very popular for old men and children.

But there is still a limitation of the swinging device. Physically challenged persons, or people who are unable to stand and have to lie on the bed cannot stand on the platform to use the swinging device. They can only do some simple stretching exercising by others' assistance so that the body will become weaker and weaker. Besides, some old people or patients having vertigo cannot have their necks hake for a long time and become another group that cannot stand on the platform to use the swinging device.

To solve the aforementioned problem, inventor invents an exercising device and the operating method thereof. The mode of the exercising device can be changed corresponding to a human body, and the swinging amplitude of the exercising device can be changed corresponding to the linear position of the exercising device. Thus the advantages of exercise strength adjusting and easy usage are achieved.

SUMMARY

According to one aspect of the present disclosure, an operating method of an exercising device includes a linear moving step and a swinging step. The linear moving step includes providing a rail pivotally disposed at a base by at least one pivoting point and moving a swinging bed or a swinging chair movably disposed on the rail for a linear movement. The swinging step changes an angle between the rail and the base to make the rail moving along a swinging path reciprocatedly.

According to another aspect of the present disclosure, an exercising device includes a base, a rail, a swinging chair, and a swinging unit. The rail is pivotally disposed at the base by at least one pivoting point. The swinging chair is movably disposed on the rail. The swinging unit is disposed between the rail and the base. The swinging unit is for changing an angle between the rail and the base.

According to further another aspect of the present disclosure, an exercising device for a human to lie includes a base, a rail, a swinging bed, and a swinging unit. The rail is pivotally disposed at the base by at least one pivoting point. The swinging bed is movably disposed on the rail. The swinging unit is disposed between the rail and the base. The swinging unit is for changing an angle between the rail and the base.

According to yet another aspect of the present disclosure, an exercising device includes a base, a rail, a swinging bed or a swinging chair, a supporting stick, and a swinging unit. The rail is pivotally disposed at the base by at least one pivoting point. The swinging bed or the swinging chair is movably disposed on the rail. One end of the supporting stick is connected to the swinging bed or the swinging chair and the other end of the supporting stick is connected to the base. The swinging unit is disposed between the rail and the base. The swinging unit is for changing an angle between the rail and the base.

According to yet another aspect of the present disclosure, an exercising device includes a base, a rail, a swinging chair, a swinging unit and an elastic unit. The rail is pivotally disposed at the base by at least one pivoting point. The swinging chair is movably disposed on the rail. The swinging unit is disposed between the rail and the base. The swinging unit is for changing an angle between the rail and the base. The elastic unit is disposed between the base and the rail, and the elastic is deformed by the reaction of the rail so as to reduce an impulse caused by the swinging unit.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
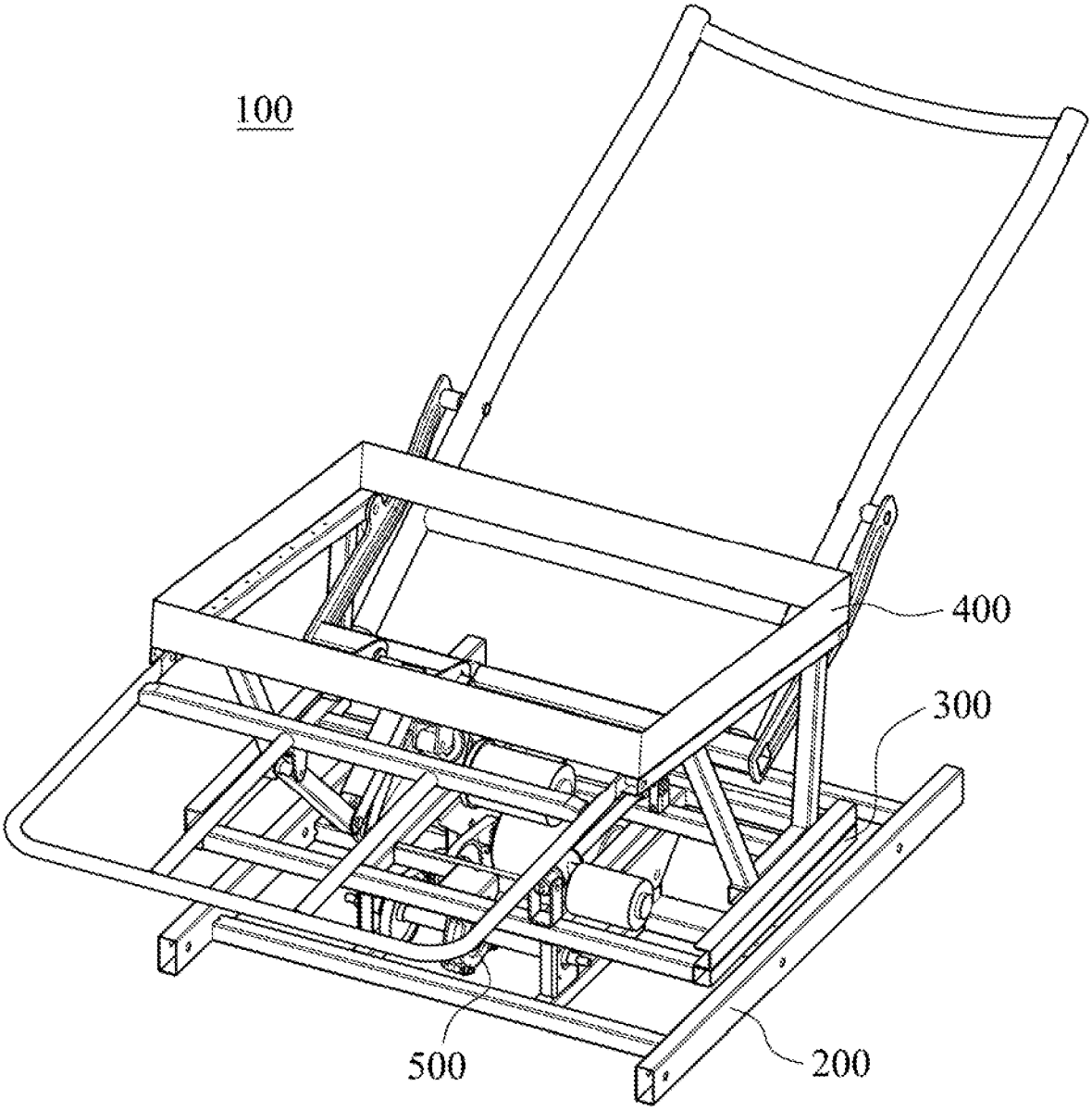
FIG. 1 is a schematic view of an exercising device according to one embodiment of the present disclosure.
Figure 2:
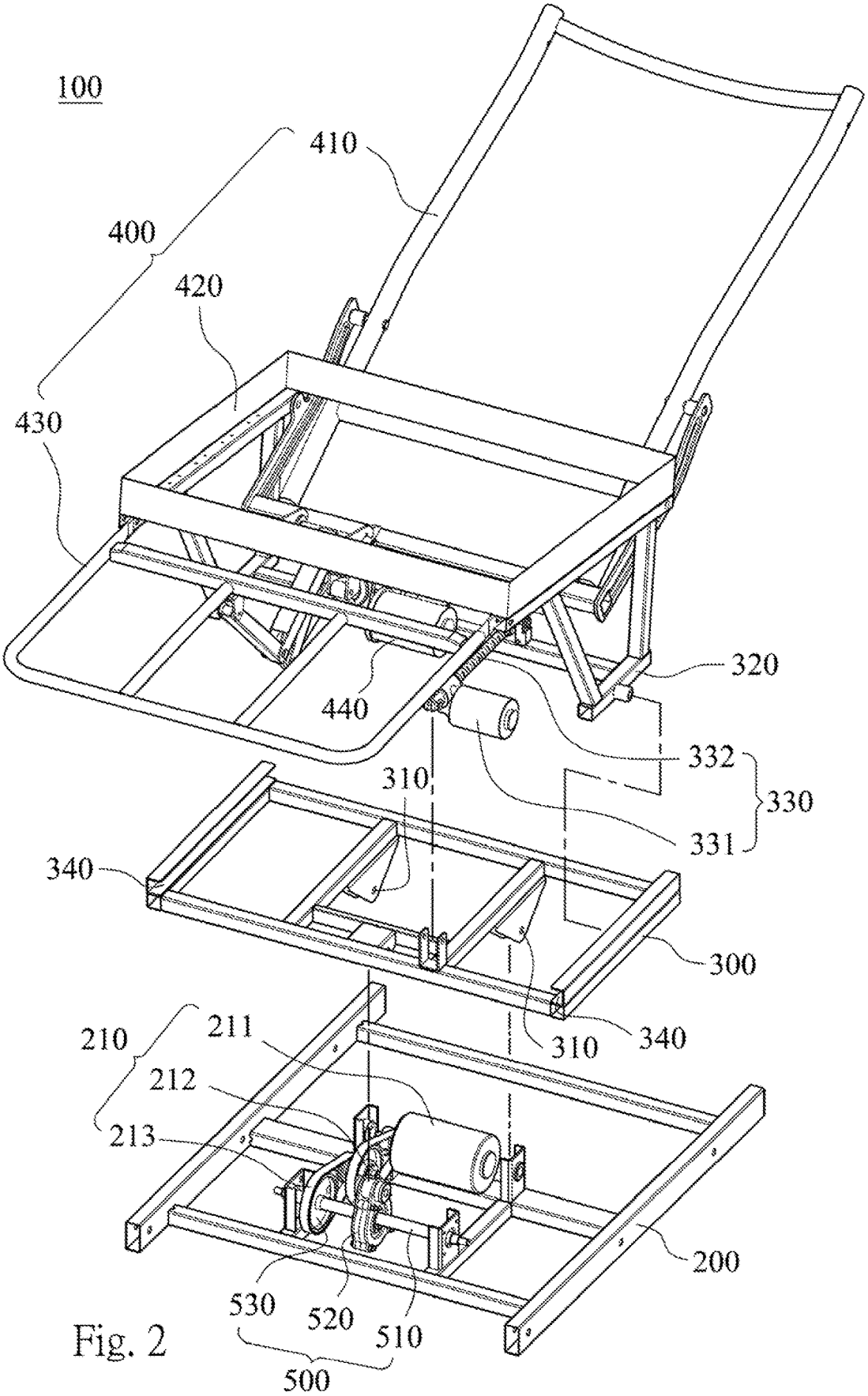
FIG. 2 is an exploded view of the exercising device as illustrated in FIG. 1.

FIG. 1 is a schematic view of an exercising device 100 according to one embodiment of the present disclosure. FIG. 2 is an exploded view of the exercising device 100 as illustrated in FIG. 1. As shown is FIGS. 1 and 2, the exercising device 100 includes a base 200, a rail 300, a swinging chair 400, and a swinging unit 500. The rail 300 is pivotally disposed at the base 200 by at least one pivoting point 310, wherein a number of the pivoting point 310 is two in the embodiment of FIG. 1. The swinging chair 400 is movably disposed on the rail 300, wherein the swinging chair 400 is moved along the rail 300 linearly. The swinging unit 500 is disposed between the rail 300 and the base 200. The swinging unit 500 is for changing an angle between the rail 300 and the base 200, precisely, the angle is determined between an extension line I1 of the rail 300 and an extension line I2 of the base 200 (see FIGS. 4 and 5). Thus, the position of the swinging chair 400 relative to the position of the base 200 along a horizontal line can be changed. When the swinging chair 400 is at different position, a force arm between the pivoting point 310 and a part of the swinging chair 400 is also changed. Therefore, a vibrating amplitude of the part of the swinging chair 400 is changed correspondingly and a swinging strength can be changed too.

Figure 3:
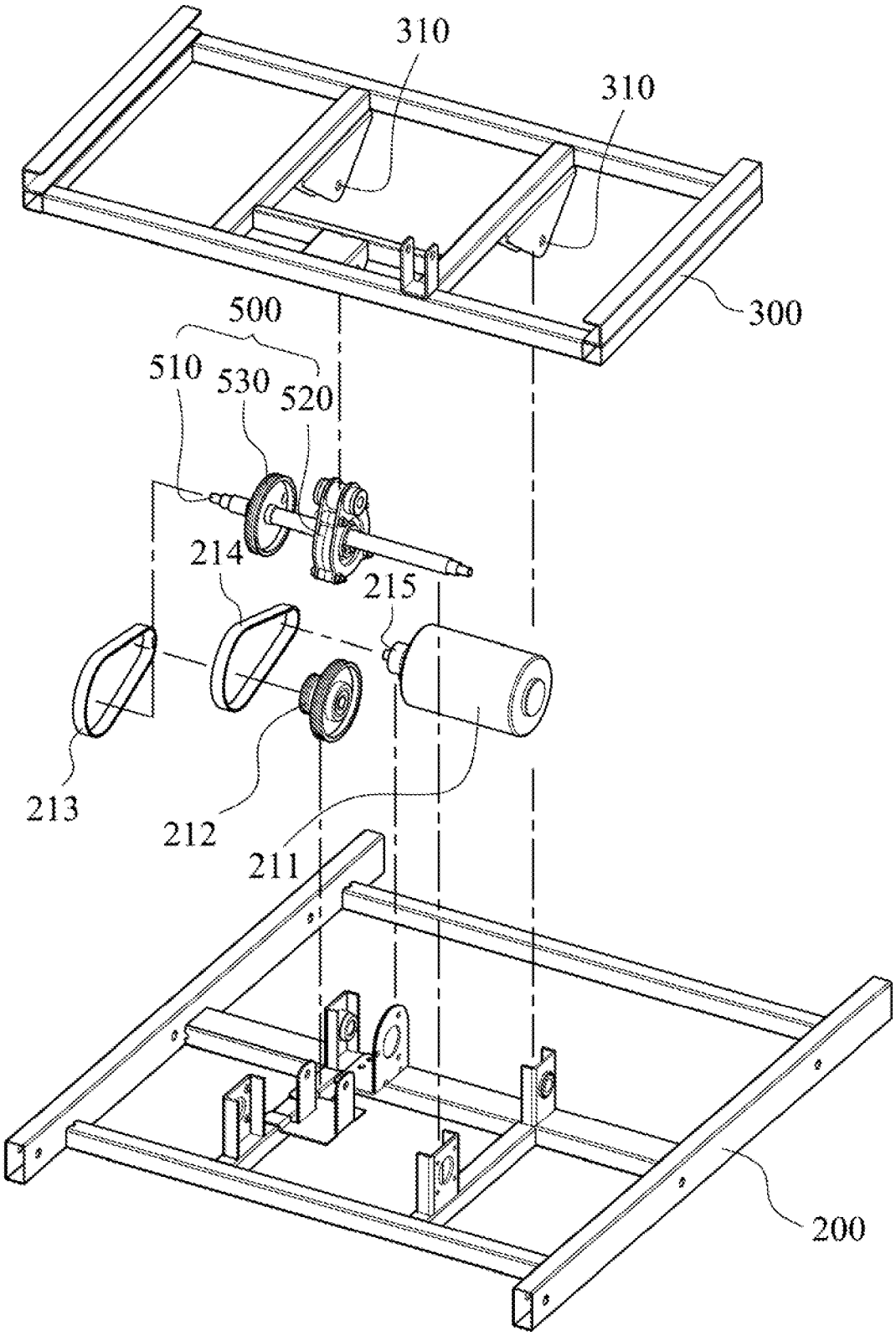
FIG. 3 is an exploded view of a swing driving unit and a swinging unit of the exercising device as illustrated in FIG. 2.

FIG. 3 is an exploded view of a swing driving unit 210 and the swinging unit 500 of the exercising device 100 as illustrated in FIG. 2. In FIGS. 2 and 3, the exercising device 100 further includes the swing driving unit 210 disposed at the base 200 for driving the swinging unit 500 to rotate, hence, the rail 300 is linked with the swinging unit 500, and the angle between the rail 300 and the base 200 is changed. In detail, the swinging unit 500 includes a roller 510, an eccentric block 520 and a wheel 530. The eccentric block 520 pushes the rail 300. The toiler 510 is rotatably disposed on the base 200. The wheel 530 and the eccentric block 520 are sleeved on the roller 510 and have no relative rotating motion with respective to the roller 510. In other words, the wheel 530 and the eccentric block 520 are fixed on the roller 510 and rotate with the roller 510 simultaneously.

The swing driving unit 210 includes a motor 211, a belt 213, a pulley 212, a motor wheel 215 and a motor belt 214. The motor wheel 215 is disposed at a shaft of the motor 211, the motor belt 214 is for connecting the motor wheel 215 to the pulley 212, and the belt 213 is for connecting the pulley 212 to the wheel 530. The motor 211 drives the motor wheel 215 and the motor belt 214 to rotate, thus the pulley 212 will be rotated simultaneously, i.e., the pulley 212 is driven by the motor 211 indirectly. When the pulley 212 is driven to rotate, the belt 213, the wheel 530, the roller 510, and the eccentric block 520 will rotate simultaneously, and the rail 300 will be pushed by the eccentric block 520. Of course, the pulley 212 can be directly disposed at the shaft of the motor 211, and the motor wheel 215 and the motor belt 214 can be omitted in other embodiment. The present disclosure will not be limited to the embodiment of FIG. 3.

Figure 4:
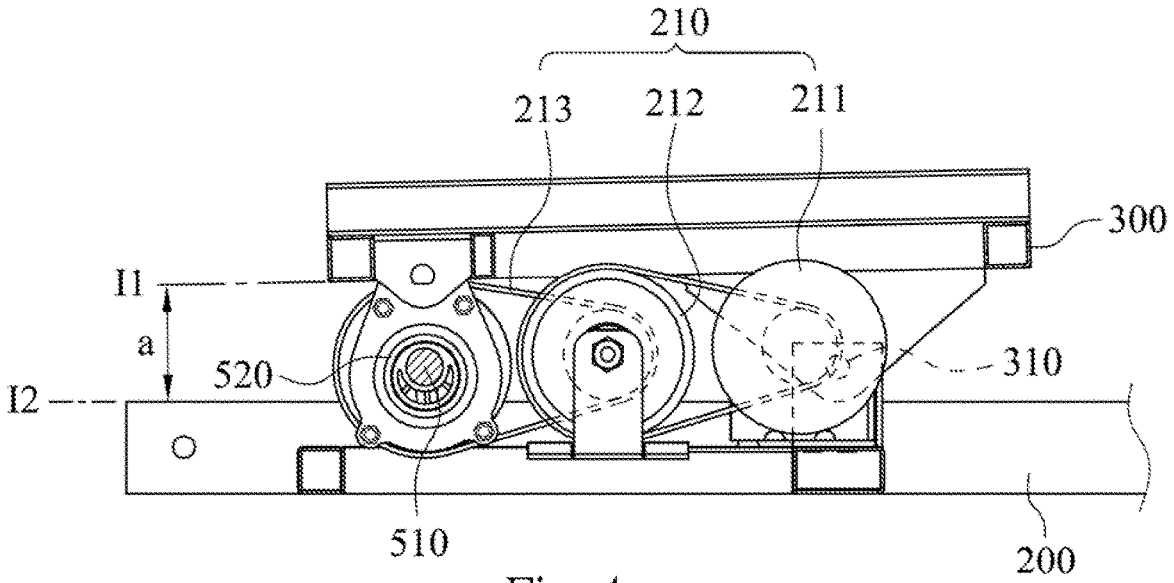
FIG. 4 is a cross-sectional view of one using state of a rail and a base as illustrated in FIG. 1.
Figure 5:
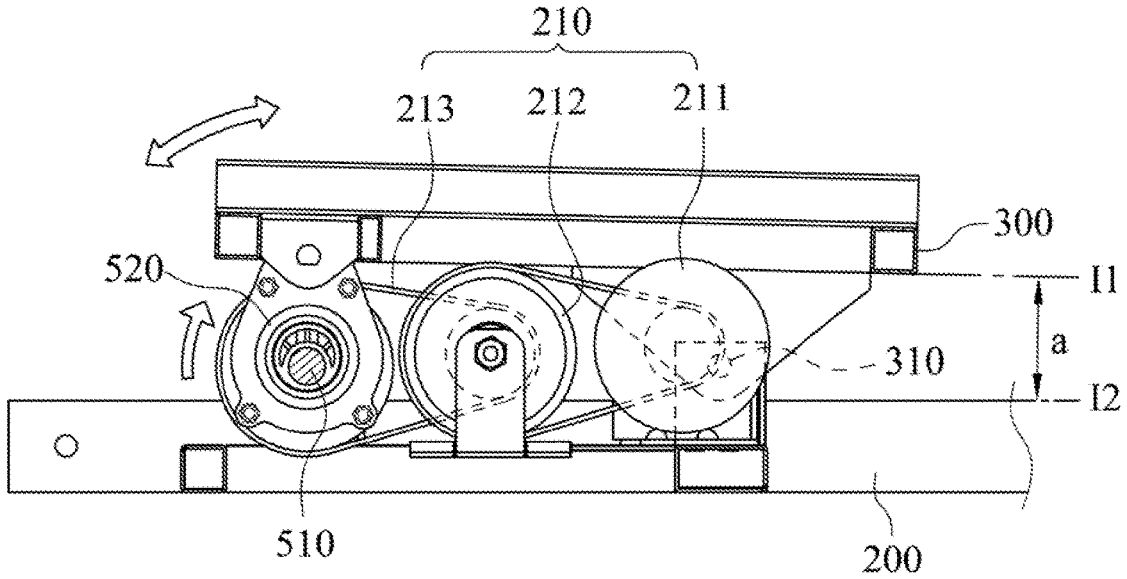
FIG. 5 is a cross-sectional view of another using state of the rail and the base as illustrated in FIG. 1.

FIG. 4 is a cross-sectional view of one using state of the rail 300 and the base 200 as illustrated in FIG. 1. FIG. 5 is a cross-sectional view of another using state of the rail 300 and the base 200 as illustrated in FIG. 1. In FIGS. 4 and 5, the angle a is changed because of the eccentric rotating motion of the eccentric block 520. Because the eccentric block 520 has different radial distances, a vertical distance between the rail 300 and the roller 510 is changed.

In other embodiment, the swing driving unit 210 can only include a motor 211, and the swinging unit 500 can include a roller 510 and an eccentric block 520. The motor 211 directly drives the roller 510 to rotate the eccentric block 520. Similarly, the swing driving unit 210 can include a motor 211 and a first gear (not shown) disposed on the shaft of the motor 211. The swinging unit 500 includes a roller 510, a second gear (not shown) engaged with the first gear, and an eccentric block 520. The first gear driven by the motor 211 is meshed with the second gear so as to rotate the roller 510 and the eccentric block 520. The structures are easily to be changed by a person skilled in the art, so that there is no need to describe the details and the present disclosure should not be limited to this.

Figure 6:
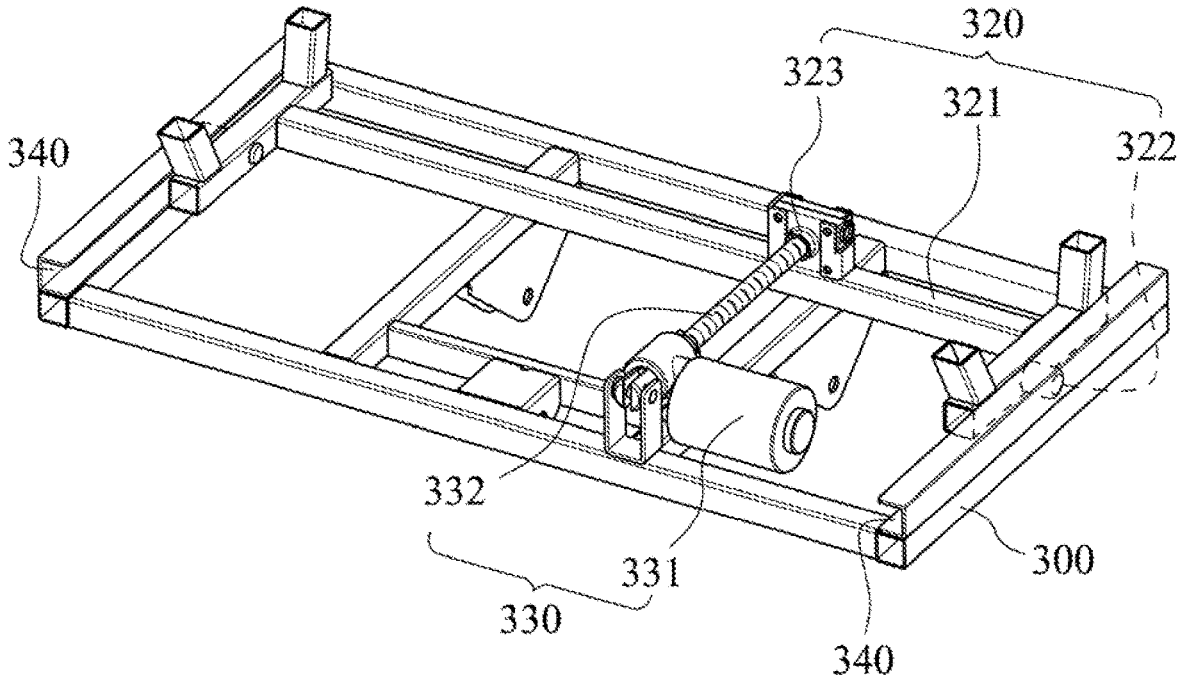
FIG. 6 is a schematic view of one using state of the rail as illustrated in FIG. 1.
Figure 7:
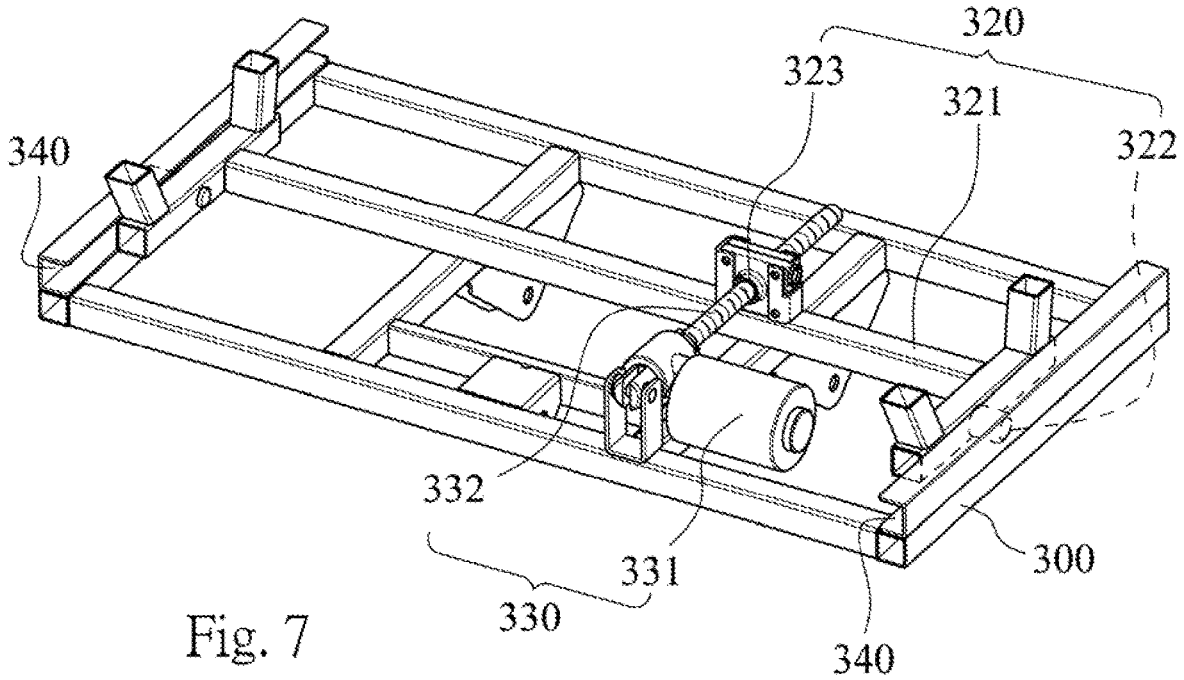
FIG. 7 is a schematic view of another using state of the rail as illustrated in FIG. 1.

FIG. 6 is a schematic view of one using state of the rail 300 as illustrated in FIG. 1. FIG. 7 is a schematic view of another using state of the rail 300 as illustrated in FIG. 1. As shown in FIGS. 6, 7 and 2, the exercising device 100 further includes a moving unit 320 and a horizontal driving unit 330, and the rail 300 further includes two grooves 340 which are parallel to each other. The moving unit 320 includes a body 321, two sliders 322, and a screw hole 323. The sliders 322 are connected to the body 321, and the screw hole 323 is disposed at the body 321. Each of the sliders 322 is disposed in each of the grooves 340. The horizontal driving unit 330 includes a motor 331 and a screw arbor 332. The motor 331 is disposed at the rail 300. One end of the screw arbor 332 is threadly disposed in the screw hole 323 and the other end of the screw arbor 332 is disposed at the rail 300. When the screw arbor 332 is driven by the motor 331 to rotate, the position of the screw hole 323 relative to the position of the screw arbor 332 will be changed simultaneously so as to make the moving unit 320 moving horizontally in the rail 300.

Figure 8:
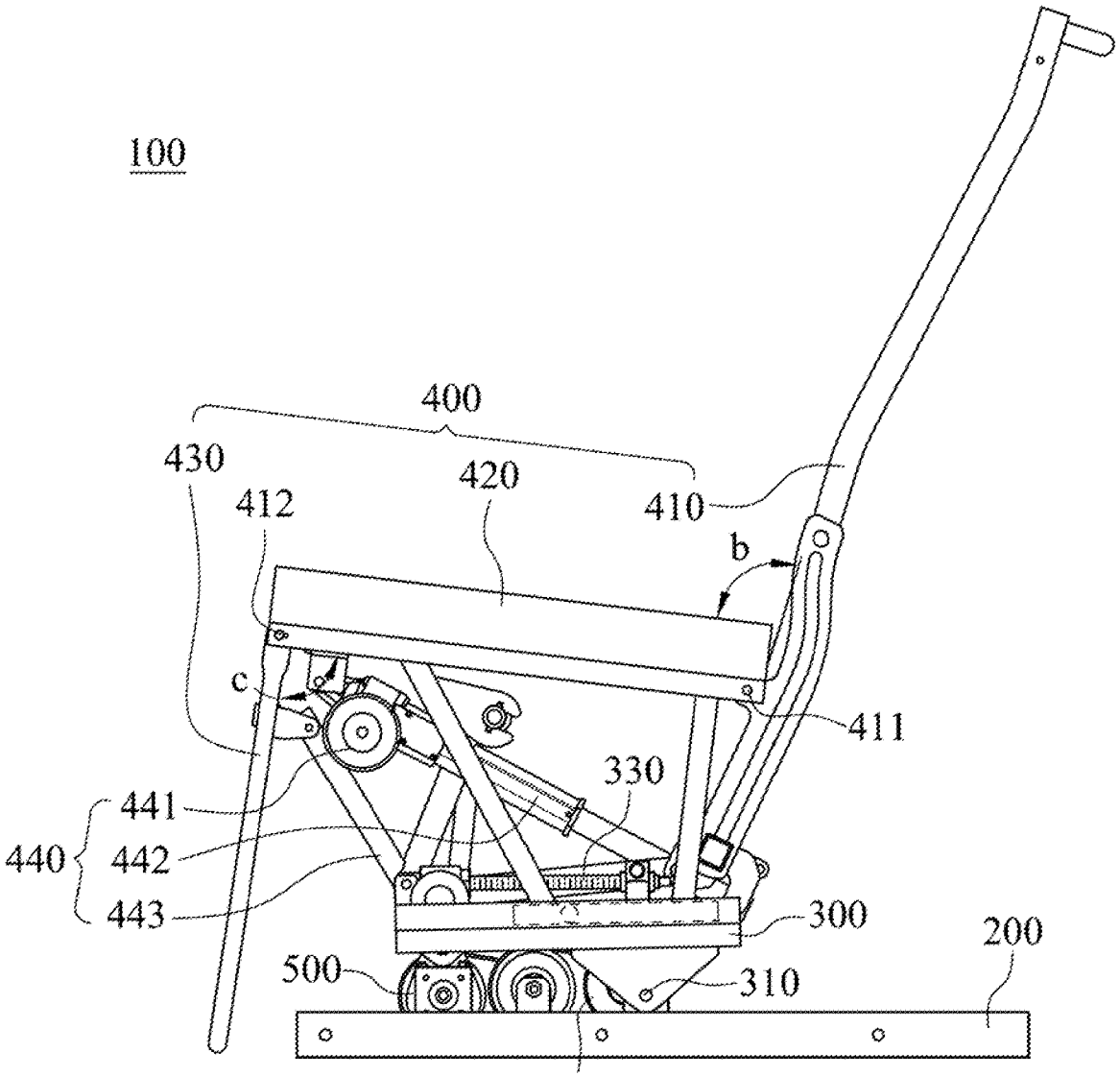
FIG. 8 is a side view of one mode of the exercising device as illustrated in FIG. 1.
Figure 9:
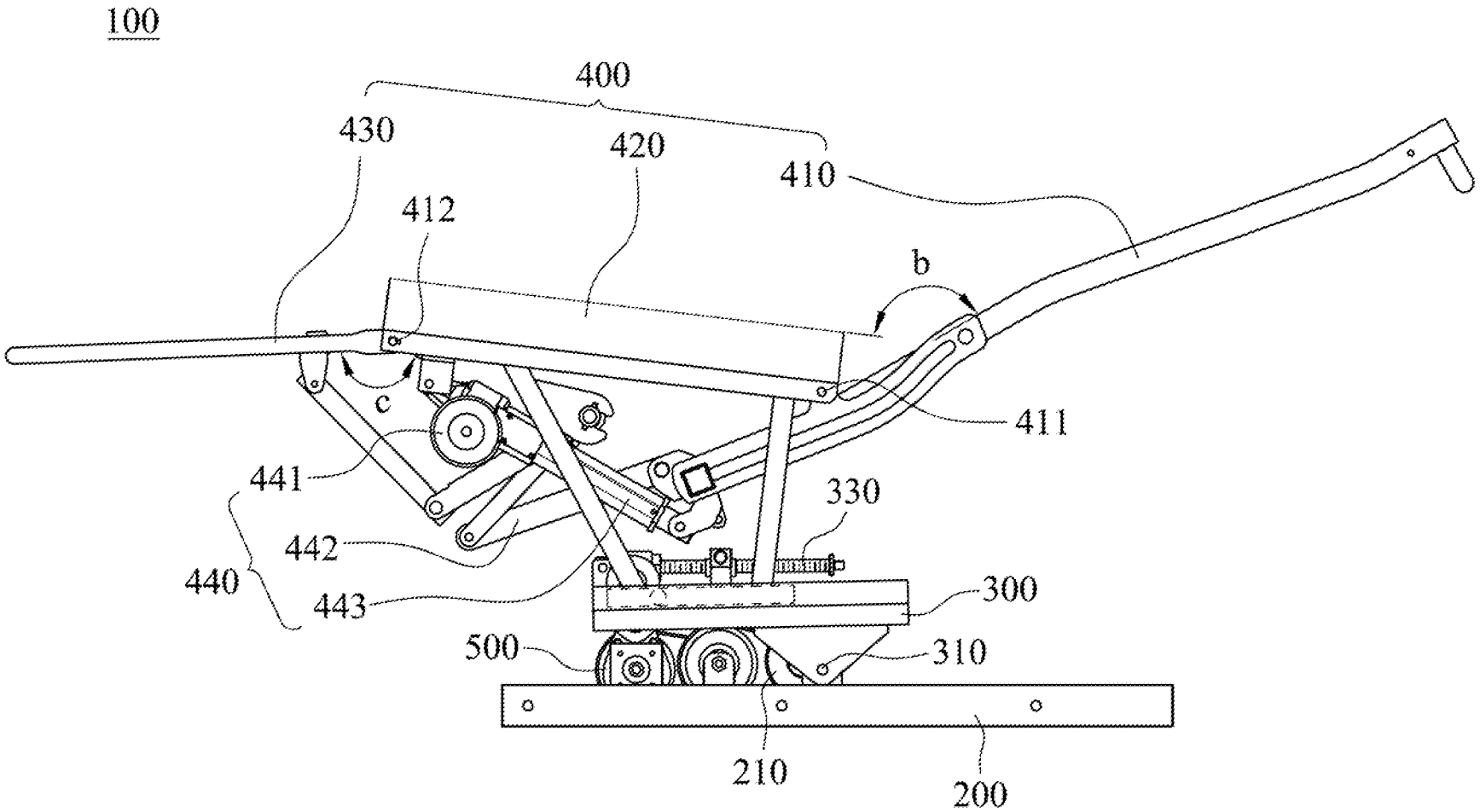
FIG. 9 is a side view of another mode of the exercising device as illustrated in FIG. 8.

FIG. 8 is a side view of one mode of the exercising device 100 as illustrated in FIG. 1. FIG. 9 is a side view of another mode of the exercising device 100 as illustrated in FIG. 8. As shown in FIG. 8 and FIG. 9, the swinging chair 400 is connected to the moving unit 320, and includes a seat portion 420, a back portion 410, a leg portion 430, and an open-close driving unit 440. The back portion 410 is pivotally disposed at the seat portion 420 by two pivoting points 411, and the leg portion 430 is pivotally disposed at the seat portion 420 by two pivoting points 412. The open-close driving unit 440 includes a motor 441, an actuator 442, and a linking rod assembly 443. One end of the actuator is pivotally disposed at the seat portion 420 and the other end of the actuator 442 is pivotally disposed at the back portion 410. Therefore, when the motor 441 drives the actuator 442 to expand or shrink, the seat portion 420, the linking rod assembly 443, and the leg portion 430 will be acted simultaneously to change an angle b between the back portion 410 and the seat portion 420 or an angle c between the seat portion 420 and the leg portion 430 so as to change the mode of the swinging chair 400. When the mode of the swinging chair 400 is changed, a posture of a human can be changed from a lying posture to a sitting posture or from a sitting posture to a lying posture. The structure of the open-close driving unit 440 mentioned before is a sampling example and other driving structures can be adapted in other embodiments.

Figure 10:
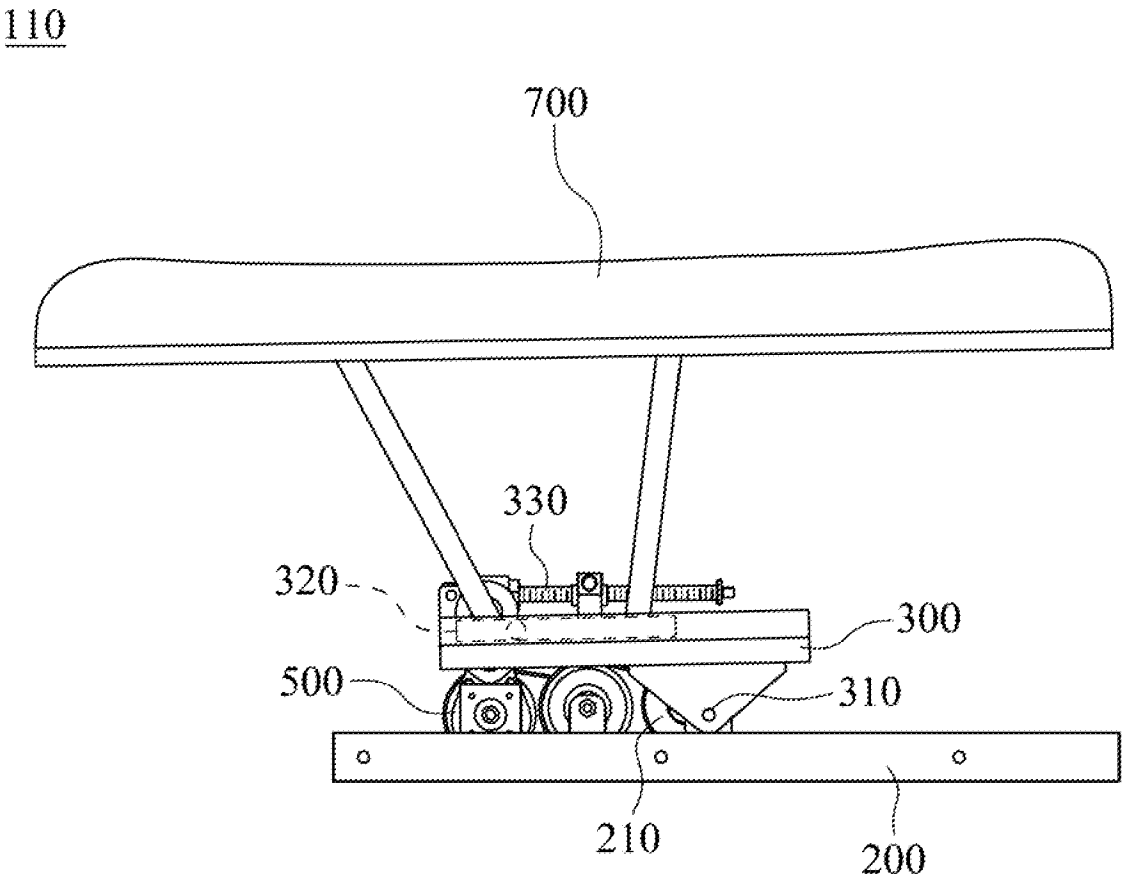
FIG. 10 is a side view of an exercising device according to another embodiment of the present disclosure.

FIG. 10 is a side view of an exercising device 110 according to another embodiment of the present disclosure. As shown in FIG. 10, the exercising device 110 includes a base 200, a rail 300, a swinging bed 700, a swinging unit 500 and a swing driving unit 210 for swinging the rail 300. The rail 300 is pivotally disposed at the base 200. The exercising device 110 further includes a moving unit 320 and a horizontal driving unit 330. The moving unit 320 is connected to the swinging bed 700, and is driven by the horizontal driving unit 330 to move horizontally in the rail 300. Therefore, the horizontal distance between the moving unit 320 and the pivoting point 310 will be changed. The mode of the swinging bed 700 can be changed corresponding to a human body (not shown). The structures and relationships of the swinging unit 500, the swing driving unit 210, the rail 300, the horizontal driving unit 330, and the moving unit 320 are similar to aforementioned structures of FIG. 1 to FIG. 9.

Figure 11:
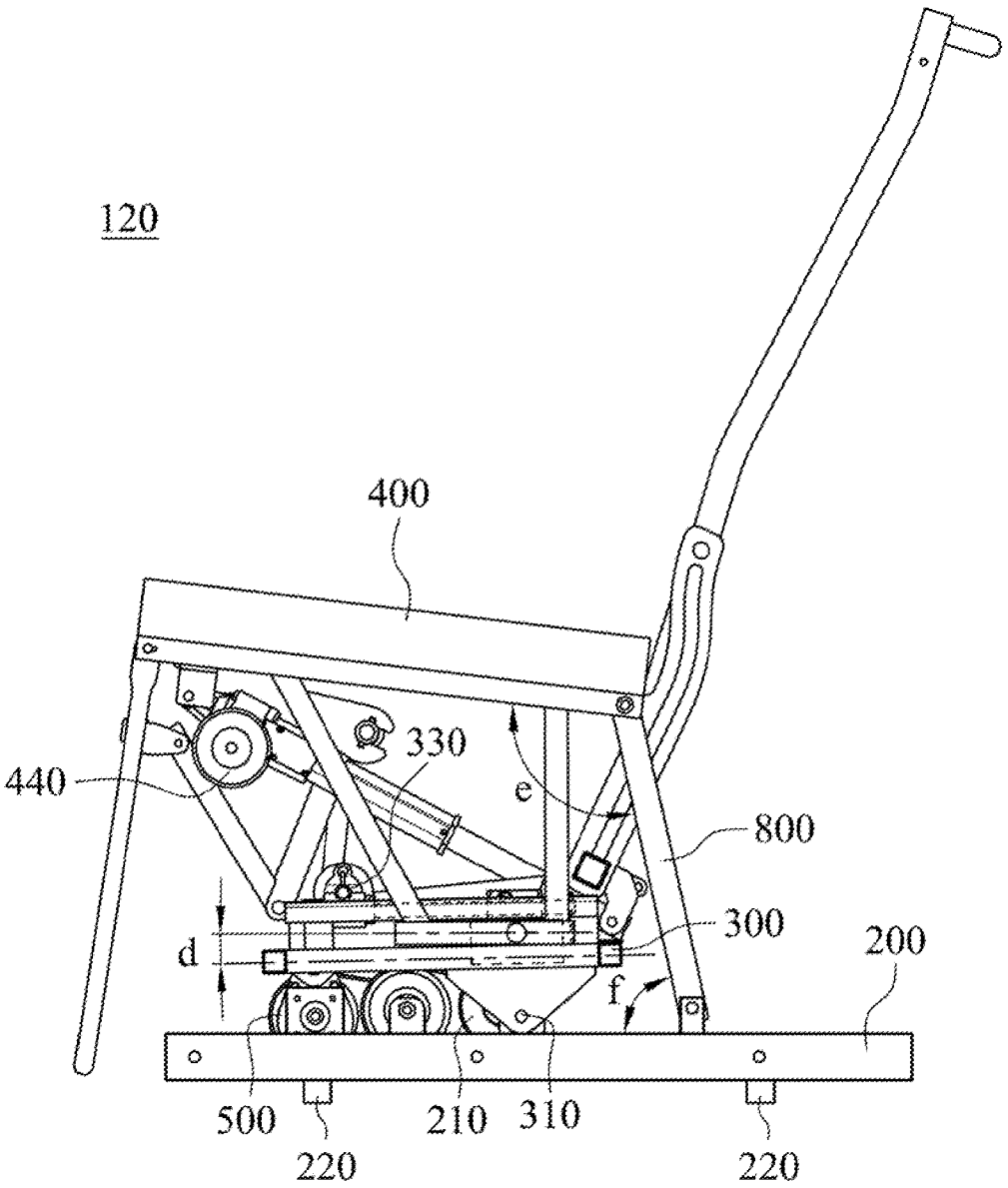
FIG. 11 is a side view of an exercising device according to yet another embodiment of the present disclosure.
Figure 12:
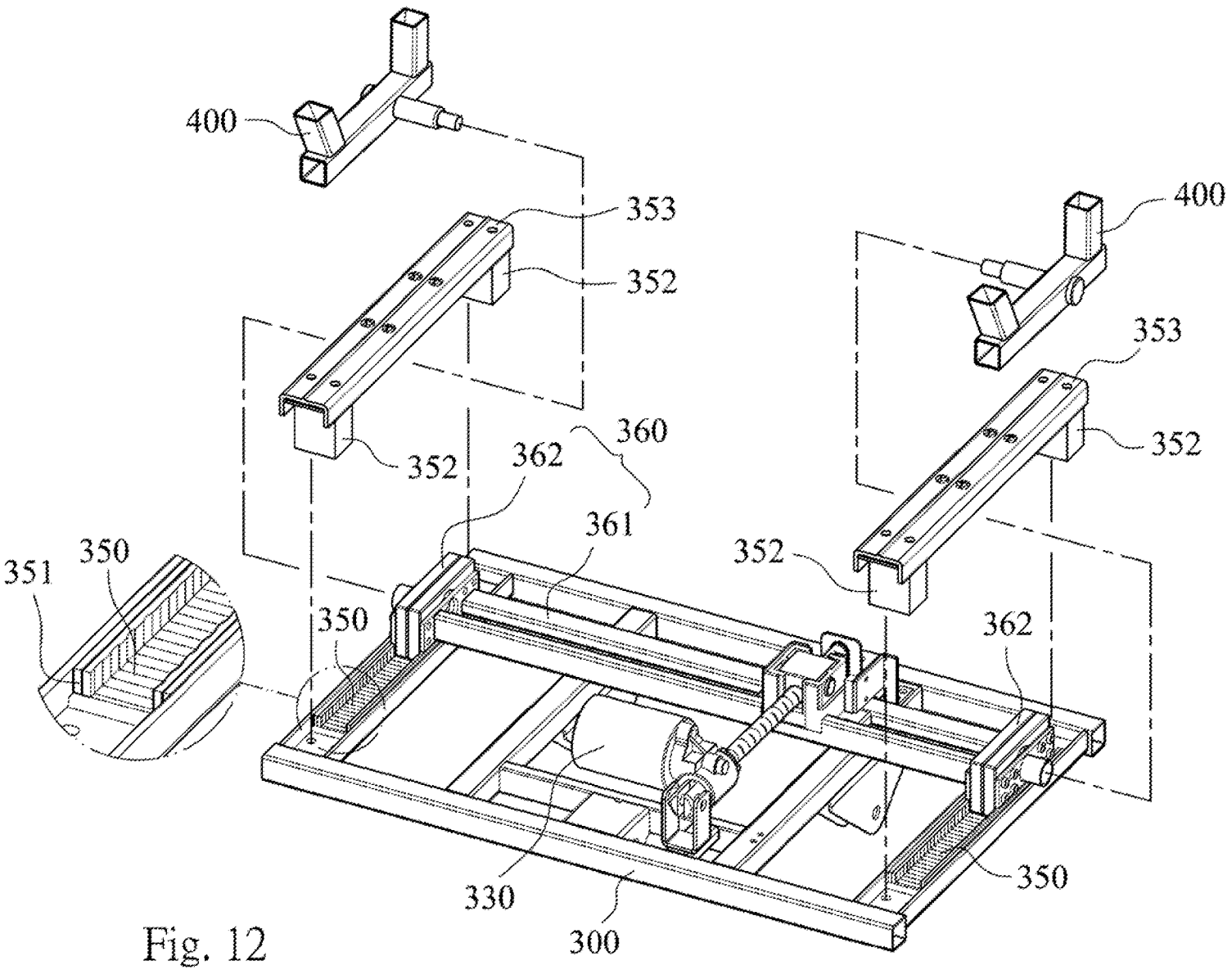
FIG. 12 is an exploded view of a rail as illustrated in FIG. 11.
Figure 13:
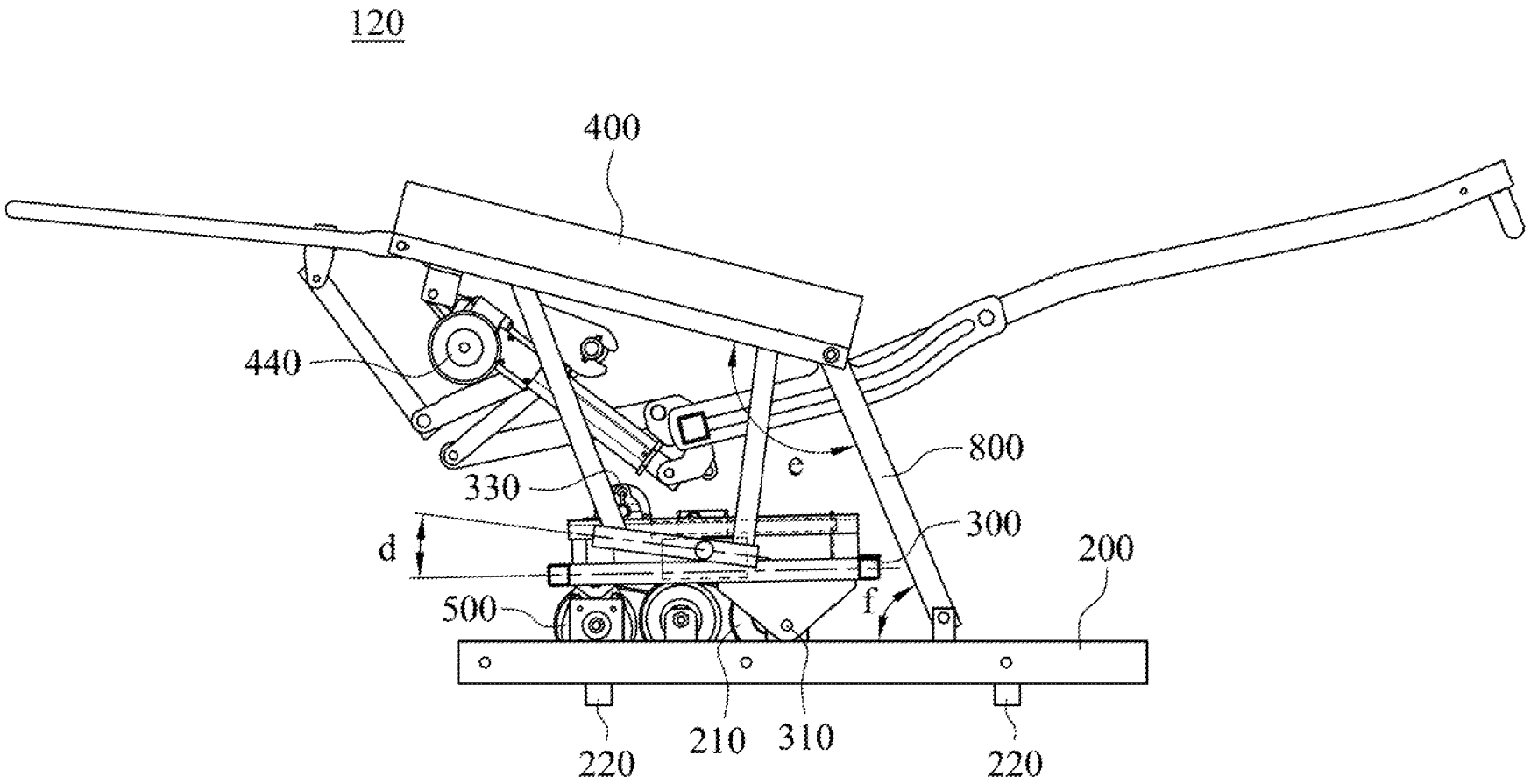
FIG. 13 is a side view of one mode of the exercising device as illustrated in FIG. 11.

FIG. 11 is a side view of an exercising device 120 according to yet another embodiment of the present disclosure. FIG. 12 is an exploded view of the rail 300 as illustrated in FIG. 11. FIG. 13 is a side view of one mode of the exercising device 120 as illustrated in FIG. 11. As shown in FIGS. 11 to 13, the exercising device 120 includes a base 200, a swinging chair 400, two supporting sticks 800, a swinging unit 500, a swing driving unit 210 for swinging the rail 300, and a moving unit 360. The rail 300 is pivotally disposed at the base 200 by the pivoting point 310, and includes two grooves 350 and two pad portions 351. Each groove 350 has an opening facing toward the swinging chair 400. Each pad portion 351 formed a plank shape is disposed at each groove 350, and is abutted against each wall of each groove 350. The moving unit 360 includes a body 361 and two sliders 362. The sliders 362 are pivotally connected to the swinging chair 400. Each slider 362 is disposed in each groove 350 and can be moved linearly along each groove 350. The rail 300 further includes two fixing boards 353 and four fixing blocks 352 which are higher than a depth of the groove 350. Two of the fixing blocks 352 are disposed in two end of one groove 350, and the other two of the fixing blocks 352 are disposed in two end of the other groove 350. The fixing board 353 is connected to the groove 350 via the fixing blocks 352 so that the slider 362 is limitedly positioned between the groove 350 and the fixing board 353. The slider 362 is driven by the horizontal driving unit 330 to move along the groove 350, and a moving distance of the slider 362 is limited by the two fixing blocks 352. The fixing board 353 is used to prevent the slider 362 separating from the groove 350 during the exercising process. The pad portion 351 is used to decrease the noise from the slider 362 during the sliding motion and thus an unwell feeling of a human can be prevented. Preferably, the pad portions 351 are sound absorbing cottons. The exercising device 120 further includes a plurality of base pads 220. The base pads 220 are disposed under the base 200 for decreasing the vibration effect between the base 200 and a surface where the exercising device 120 is positioned.

The swinging chair 400 is driven by the horizontal driving unit 330 to move horizontally in the rail 300 so as to change a horizontal distance between the moving unit 360 and the pivoting point 310. The mode of the swinging chair 400 can be changed corresponding to a human body via the open-close driving unit 440. Therefore, an angle d between the swinging chair 400 and the rail 300, an angle e between the swinging chair 400 and the supporting stick 800, and/or an angle f between the supporting stick 800 and the base 200 will be changed to make the mode of the swinging chair 400 changing more smoothly. By controlling the open-close driving unit 440 to change each of the angles, the variation of the swinging amplitude for different human part at different position will increase. The structures of the swinging unit 500, the swing driving unit 210, the open-close driving unit 440, the swinging chair 400 and the horizontal driving unit 330 are similar to the aforementioned structures of FIG. 1 to FIG. 9, and there is no need to describe the devils.

Figure 14:
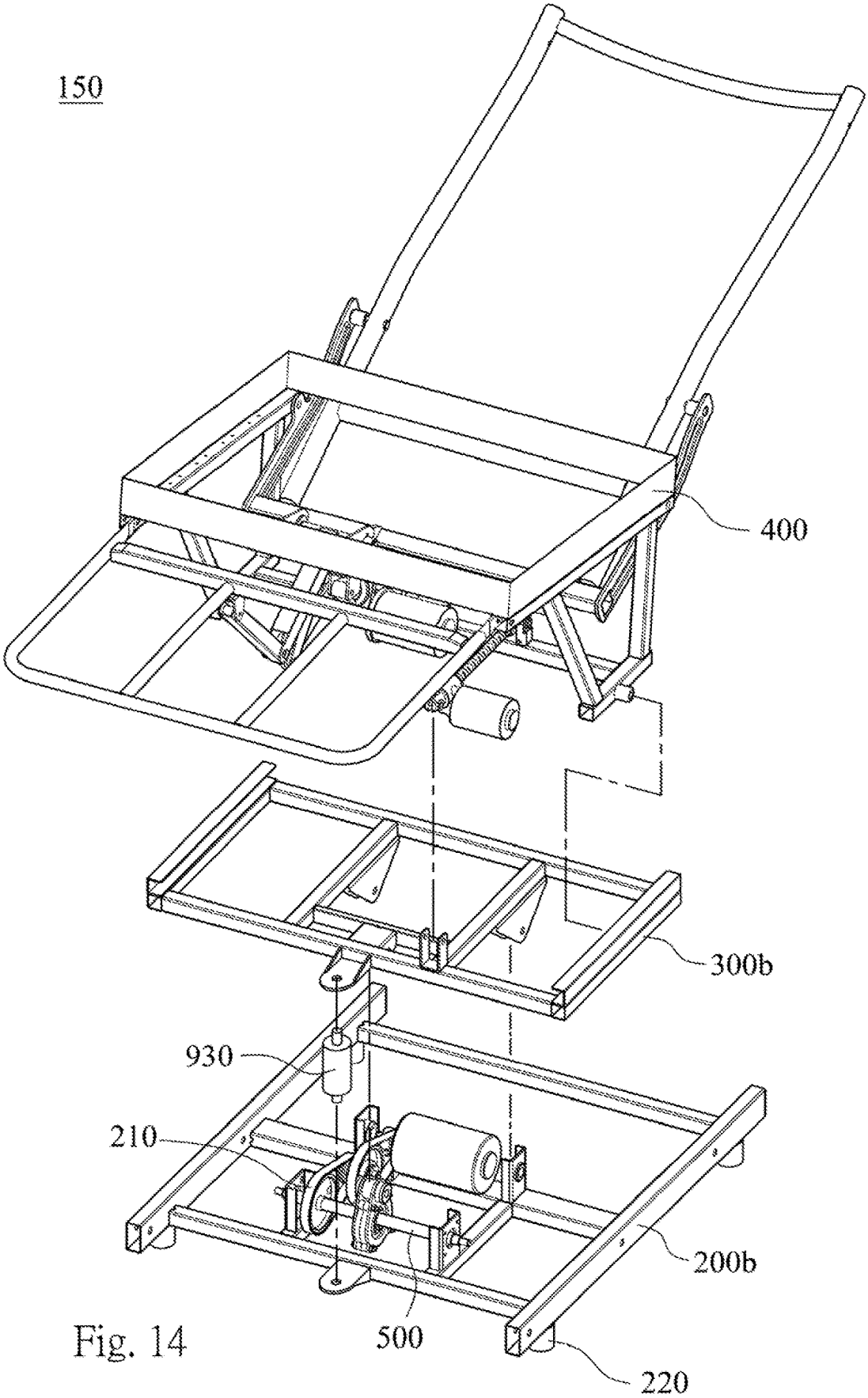
FIG. 14 is an exploded view of an exercising device according to yet another embodiment of the present disclosure.

FIG. 14 is an exploded view of an exercising device 150 according to yet another embodiment of the present disclosure. As shown in FIG. 14, exercising device 150 includes a base **200*b*, a rail 300*b*, a swinging chair 400, a swinging unit 500, an elastic unit 930, a swing driving unit 210 and a plurality of base pads. The structures of the swinging chair 400, the swinging unit 500 and the swing driving unit 210 are similar to the structures of the embodiment shown in FIGS. 1 to 9, the structure of the base pad 220 is similar to the embodiment shown in FIGS. 11 to 13, and there is no need to describe in detail. The elastic unit 930 is disposed between the base 200*b* and the rail 300*b*; and can be deformed to reduce an impulse caused by the rail 300*b***.

Figure 15A:
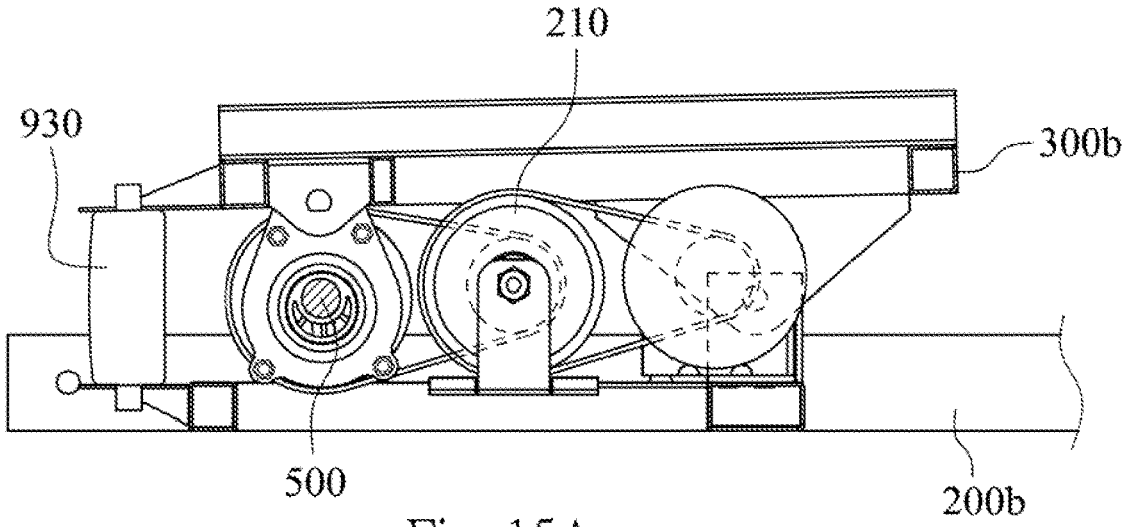
FIG. 15A is a cross-sectional view of one using state of a rail, a base and an elastic unit as illustrated in FIG. 14.
Figure 15B:
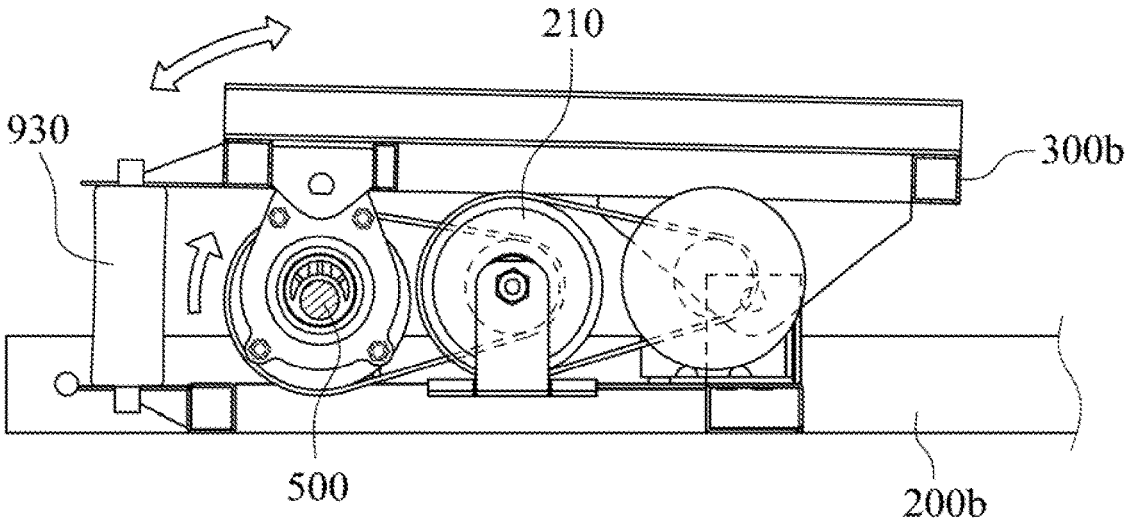
FIG. 15B is a cross-sectional view of another using state of the rail, the base and the elastic unit as illustrated in FIG. 14.

FIG. 15A is a cross-sectional view of one using state of the rail **300*b*, the base 200*b* and the elastic unit 930 as illustrated in FIG. 14, and FIG. 15B is a cross-sectional view of another using state of the rail 300*b*, the base 200*b* and the elastic unit 930 as illustrated in FIG. 14. Specially, a swinging motion of rail 300*b* is caused by the swinging unit 500, and a distance between the rail 300*b* and the base 200*b* is changed accordingly. As shown in FIGS. 15A and 15B, the elastic unit 930 is deformed by the swinging motion of the rail 300*b*. When the rail 300*b* swings from the highest point toward the lowest point, the gravity and the inertia force of the eccentric block result in producing an impetuous impulse toward a ground where the exercising device 150 (see FIG. 15) is disposed. Thus the rail 300*b* and the swinging chair 400 cannot swing smoothly because of the impulse, and a user will feel unwell. Through disposing the elastic unit 930 between the rail 300*b* and the base 200*b*, the impulse can be absorb by the elastic unit 930, and a user will feel more comfortable when using the exercising device 150**.

The elastic unit 930 is comprised by the rail **300*b* in FIG. 15A while extended by the rail 300*b* in FIG. 15B. In other embodiment, the elastic unit 930 can only be comprised but not be extended, and keeps an original height while the rail 300*b*** is at the highest position.

Figure 16:
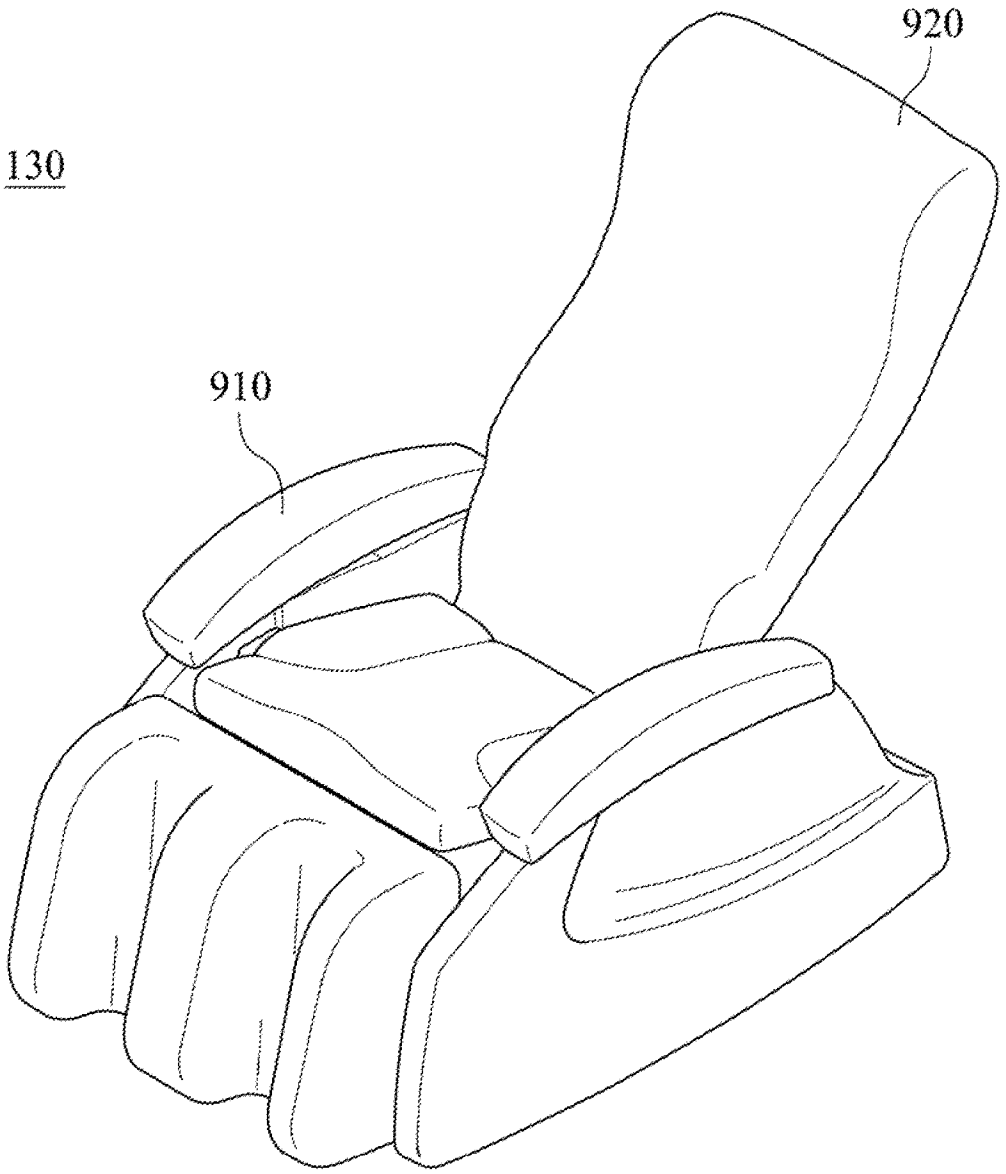
FIG. 16 is a schematic view of an exercising device according to yet another embodiment of the present disclosure.

FIG. 16 is a schematic view of an exercising device 130 according to yet another embodiment of the present disclosure. As shown in FIG. 16, the exercising device 130 further includes two armrests 910 and a chair cover 920. By the assistance of the armrests 910 and the chair cover 920, the user will feel more comfortable when using the exercising device 130. In FIG. 11 to FIG. 16, each of the exercising device 120, the exercising device 130, and the exercising device 150 includes the swinging chair 400, and the swinging chair 400 can be replaced by a swinging bed in other embodiments.

The swinging speed of the swing driving unit will affect the swinging status of the exercising device. As the aforementioned description, the swinging unit swings eccentrically to drive the exercising device swinging simultaneously. When the swinging speed of the swinging unit becomes higher, the exercising device will swing faster and the user will feel the body shaking up and down with small amplitude and higher speed. On the other way, when the swinging speed of the swinging unit becomes lower, the exercising device will swing slower and the user will feel the body swinging forward and backward. The swinging motion is smooth and the body swings in a circle. Further with the function of linear motion, the exercising device can be at different position and can have different swing speed so as to bring different feeling to users. Thus the user can choose a love way to swing.

Figure 17:
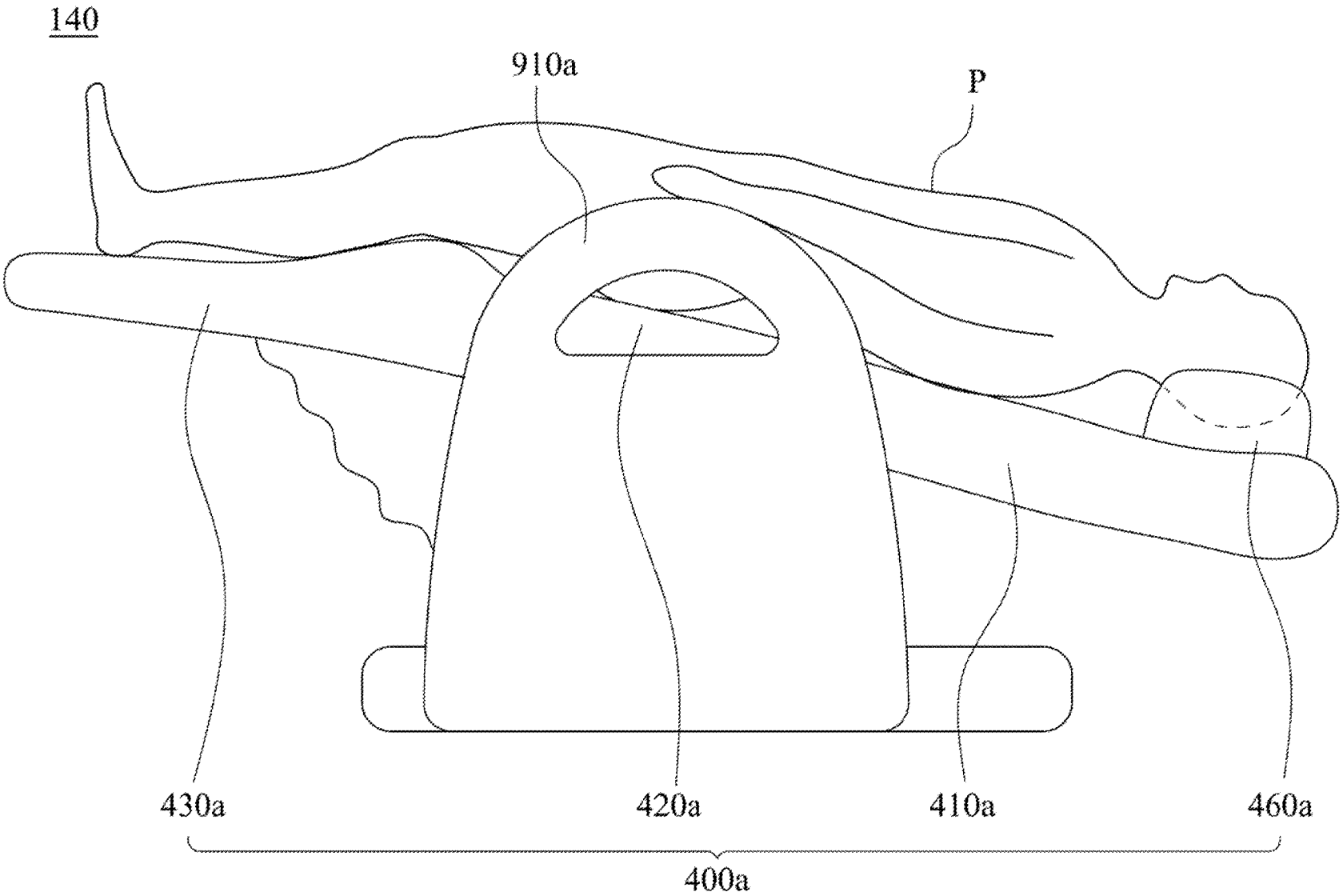
FIG. 17 is a side view showing one using status of an exercising device according to yet another embodiment of the present disclosure.

FIG. 17 is a side view showing one using status of an exercising device 140 according to yet another embodiment of the present disclosure. As shown in FIG. 17, the inside structure of the exercising device 140 cannot be seen because of the chair cover, and the basic structures are similar to the aforementioned structures of FIG. 1 to FIG. 9. The swinging chair 400*a* includes a back portion 410*a*, a seat portion 420*a*, a leg portion 430*a*, and a pillow 460*a*. The swinging chair 400*a* is in a mode for a human to lying. The pillow 460*a* disposed on the back portion 410*a* is for a user P to lean his or her head on. The pillow 460*a* is disposed to confirm the ergonomic effect and increases the comfortable feeling of user P. Moreover, the pillow 460*a* can help to fix the position of the head of user p and prevent the head shaking too much during the swinging process. Preferably, the pillow 460 has shock absorbing function. Besides, the swinging chair 400*a* further includes two armrests 910*a* disposed at two sides of the seat portion 420*a*, respectively.

When the user P is lying, his or her hands will be put on the armrest 910*a*, and the hands and the legs will be at a higher position than his or her heart. Because the blood is concentrated on the hands and the legs for a seating posture and a standing posture, the blood hardly returns to the heart. Therefore, the positions of the hands and the legs are designed to be higher than the position of the heart, and the blood returns to the heart from the hands and the legs to increase the blood circulating by the assistance of the swinging function of the exercising device 140.

Besides, the back portion 410*a* can includes a plurality of airbags (not shown) and a plurality of massagers (not shown). Through the inflation and deflation motion of the airbags, and the swinging and moving motion of the massagers, a massage effect on back can be achieved. Similarly, the seat portion 420*a* can also includes a plurality of airbags so as users can enjoy the massage effect for leg and hip. The inflation and deflation motion of the aforementioned airbags can be acted simultaneously or non-simultaneously and thus the massage effect becomes diversifying.

Figure 18:
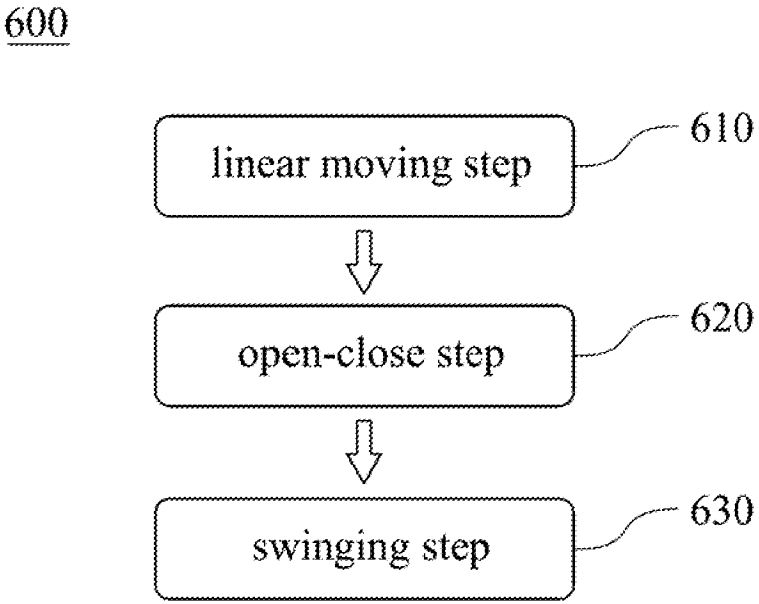
FIG. 18 is a flow diagram of an operating method of the exercising device as illustrated in FIG. 1 according to yet another embodiment of the present disclosure.

FIG. 18 is a flow diagram of an operating method of the exercising device 100 as illustrated in FIG. 1 according to yet another embodiment of the present disclosure. The operating method 600 of the exercising device 100 includes a linear moving step 610 and a swinging step 630. The linear moving step 610 includes providing a rail 300 pivotally disposed at a base 200 by two pivoting points 310, moving the swinging bed 700 or the swinging chair 400 movably positioned on the rail 300, and providing a horizontal driving unit 330 to drive the swinging bed 700 or the swinging chair 400 moving in the rail 300 linearly. The swinging step 630 includes providing a swing driving unit 210 for driving a swinging unit 500 to change an angle a between the rail 300 and the base 200 so that the rail 300 moves along a winging path reciprocatedly. In the embodiment of FIG. 18, the linear moving step 610 provides the linear movement of the swinging bed 700 or the swinging chair 400 first, and then the swinging step 630 vibrates the rail 300 to swing the swinging bed 700 or the swinging chair 400. Besides, the operating method can further include an open-close step 620. The open-close step 620 provides an open-close driving unit 440 to change a mode of the exercising device 100 corresponding to a human. In the embodiment of FIG. 18, the linear moving step 610 is the first step, the open-close step 620 is the second step, and the swinging step 630 is the final step. In other embodiment, the sequence of the linear moving step 610 and the open-close step 620 can be changed. For example, the open-close step 620 becomes the first step, the linear moving step 610 becomes the second step, and the swinging step 630 is remained to be the final step. In yet another embodiment, the open-close step 620 and the linear moving step 610 can be acted simultaneously and the swing step can be acted soon after. Of cause, all the steps can be acted simultaneously.

According to the aforementioned embodiments, the present disclosure has the following advantages.

1. Through the operating method of the exercising device, the horizontal position of the swinging chair or the swinging bed can be changed according to the demand of the user. The mode of the exercising device can be changed corresponding to a human body so that the user can choose different exercising posture, like sitting posture or lying posture. Moreover, the swinging level and swinging strength for different part of the human body can be changed according to the horizontal position of the exercising device.

2. Through the linear motion structures of the exercising device, the horizontal position of the swinging bed or the swinging chair can be changed, and the force arm between the pivoting point and the part of the human body will be changed together. When a person is sitting on the swinging chair to swing, the horizontal distance between the vertical line of the head and the pivoting point becomes short and thus the force arm becomes short too. Therefore, the swinging amplitude of the head is small and an unwell feeling from head shaking can be reduced. The swinging amplitude of other part of the human body is proportional to the force arm, and an exercising effect of other part of the human body can also be achieved. Specially, the changing of the horizontal position of the swinging bed or the swinging chair will result in changing the corresponding vibrating part of the human body. Choices of a user will increase.

3. Besides, when the distance between the pivoting point and the moving unit becomes closer, the swinging amplitude of the rail becomes smaller, too. On the other way, when the distance between the pivoting point and the moving unit becomes farer, the swinging amplitude of the rail becomes larger so that the swinging amplitude of the swinging bed or the swinging chair will also becomes larger. Therefore, the exercising strength of the exercising device can be changed.

4. If the swinging chair is pivotally connected to the rail, or the exercising device further includes a supporting stick for pivotally connecting to the rail and the swinging chair, the angle between the rail and the swinging chair, the angle between the supporting stick and the swinging chair, and/or the angle between the supporting stick and the base can be driven to changed. The swinging amplitude corresponding to the different part of the swinging chair becomes more diversified with the structure of multi-pivoting points, and the types of different swinging motion will be increased. For example, the swinging motion can be an up-and-down motion or a circular swinging motion. The smoothness of the open-close operation or the linearly moving operation can be increased with the structure and thus the comfortable feelings of users will also be improved.

5. When the swinging bed or the swinging chair further includes the supporting stick, the open-closed operation for changing the mode or the swinging bed or swinging chair becomes smoother. The structure stronger during the swinging process with the supporting of the supporting stick. The angles of the seat portion can also be changed so that the swinging motion becomes more diversified.

6. The sound making by the horizontal linear moving motion of the exercising device can be decrease via the pad portion which is disposed in the groove of the rail, and thus an operating noise can be prevented. Besides, a dimensional tolerance of the groove and the slider can be made larger if the pad portion is disposed in the groove. Therefore, a manufacturing cost as well as difficulties of manufacturing process can be reduced.

7. The mode of the exercising chair can be changed via the open-close structure of the exercising device and the operating convenience can be improved.

8. The different of the swinging speed of the swinging unit makes the user feeling different swinging motion. When the swinging speed is high, the swinging amplitude of human body is small, and the user will feel swing up and down with whole body shaking. When the swinging speed is small, the swinging amplitude of the human body is large, and the user will feel swing backward and forward with the body swinging circularly. Therefore, the exercising device can provides different exercising effect.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. An operating method of an exercising device, comprising:

providing only one rail pivotally disposed at a base by at least one pivoting point, wherein the rail comprises two rail frames arranged at two sides of the base, respectively;

operating a horizontal driving unit to move a swinging bed or a swinging chair along the rail for a linear movement relative to the base, wherein the swinging bed or the swinging chair is pivotally connected to the rail by two sliders, a number of the sliders is limited to two, and each of the two sliders is connected to each of the rail frames; and operating a swinging unit to change an angle between the rail and the base to make the rail move along a swinging path reciprocatedly;

wherein a force arm between the pivoting point and each of the sliders is changed when the swinging bed or the swinging chair is moved such that when the swinging bed or the swinging chair is vibrated relative to the rail, a vibrating amplitude of the swinging bed or the swinging chair is changed correspondingly.

2. The operating method of claim 1, wherein after operating the horizontal driving unit to move the swinging chair or the swinging bed, operate the swinging unit to vibrate the rail, and the swinging bed or the swinging chair is linked with the rail.

3. An exercising device, comprising:

a base;

a rail pivotally disposed at the base by at least one pivoting point, wherein the rail comprises two rail frames arranged at two sides of the base, respectively, and a number of the rail is limited to one;

a swinging chair movable along the rail for a linear movement relative to the base, wherein the swinging chair is pivotally connected to the rail by two sliders, a number of the sliders is limited to two, and each of the two sliders is connected to each of the rail frames; and a swinging unit disposed between the rail and the base, the swinging unit comprising an eccentric block to vibrate the rail;

wherein when the swinging chair is moved, a position of the swinging chair relative to a position of the base along a horizontal line is changed such that a force arm between the pivoting point and each of the sliders is changed and a vibrating amplitude of the swinging chair is changed correspondingly when the swinging chair is vibrated relative to the rail.

4. The exercising device of claim 3, further comprising:

a horizontal driving unit, comprising a motor driving the two sliders to move in the rail, thus the swinging chair being linked with the two sliders and moved along the rail.

5. The exercising device of claim 4, wherein, the horizontal driving unit comprises a screw arbor, wherein the motor drives the screw arbor; and a moving unit comprises a body and a screw hole coordinated with the screw arbor, wherein the two sliders are connected to the body, the screw hole is disposed at the body, and when the motor drives the screw arbor, the two sliders are moved in the rail.

6. The exercising device of claim 3, wherein the swinging unit further comprises:

a roller rotatably disposed at the base, wherein the eccentric block sleeves on the roller and pushes the rail; and a wheel sleeved on the roller.

7. The exercising device of claim 6, further comprising a swing driving unit disposed at the base, wherein the swing driving unit comprises a motor driving the swinging unit to rotate.

8. The exercising device of claim 7, wherein the swing driving unit comprises:

a pulley driven by the motor; and a belt connecting the pulley to the wheel;

wherein the motor drives the pulley, the belt, the wheel, the roller and the eccentric block to rotate simultaneously.

9. An exercising device for a human to lie, comprising:

a base;

a rail pivotally disposed at the base by at least one pivoting point, wherein the rail comprises two rail frames arranged at two sides of the base, respectively, and a number of the rail is limited to one;

a swinging bed movable along the rail for a linear movement relative to the base, wherein the swinging bed is pivotally connected to the rail by two sliders, a number of the sliders is limited to two, and each of the two sliders is connected to each of the rail frames; and a swinging unit disposed between the rail and the base, the swinging unit comprising an eccentric block to vibrate the rail;

wherein when the swinging bed is moved, a position of the swinging bed relative to a position of the base along a horizontal line is changed such that a force arm between the pivoting point and each of the sliders is changed and a vibrating amplitude of the swinging bed is changed correspondingly when the swinging bed is vibrated relative to the rail.

10. The exercising device of claim 9, further comprises:

a horizontal driving unit, comprising a motor driving the two sliders to move in the rail, thus the swinging bed being linked with the two sliders and moved along the rail.

11. The exercising device of claim 10, wherein, the horizontal driving unit comprises a screw arbor, wherein the motor drives the screw arbor; and a moving unit comprises a body and a screw hole coordinated with the screw arbor, wherein the two sliders are connected to the body, the screw hole is disposed at the body, and when the motor drives the screw arbor, the two sliders are moved in the rail.

12. An exercising device, comprising:

a base;

a rail pivotally disposed at the base by at least one pivoting point, wherein the rail comprises two rail frames arranged at two sides of the base, respectively, and a number of the rail is limited to one;

a swinging bed or a swinging chair movable along the rail for a linear movement relative to the base, wherein the swinging bed or the swinging chair is pivotally connected to the rail by two sliders, a number of the sliders is limited to two, and each of the two sliders is connected to each of the rail frames;

a supporting stick, wherein one end of the supporting stick is pivotally connected to the swinging bed or the swinging chair, and the other end of the supporting stick is pivotally connected to the base; and a swinging unit disposed between the rail and the base, the swinging unit comprising an eccentric block to vibrate the rail;

wherein a force arm between the pivoting point and each of the sliders is changed when the swinging bed or the swinging chair is moved such that when the swinging bed or the swinging chair is vibrated relative to the rail, and a vibrating amplitude of the swinging bed or the swinging chair is changed correspondingly.

13. The exercising device of claim 12, further comprising:

a horizontal driving unit, comprising a motor driving the two sliders to move in the rail, thus the swinging bed or the swinging chair being linked with the two sliders and moved along the rail.

14. The exercising device of claim 13, wherein, the horizontal driving unit comprises a screw arbor, wherein the motor drives the screw arbor; and a moving unit comprises a body and a screw hole coordinated with the screw arbor, wherein the two sliders are connected to the body, the screw hole is disposed at the body, and when the motor drives the screw arbor, the two sliders are moved in the rail.

15. The exercising device of claim 14, wherein the swinging bed or the swinging chair is pivotally connected to the moving unit.

16. The exercising device of claim 15, wherein the rail comprises a groove and a pad portion, the moving unit is movably disposed in the groove, and the pad portion is positioned in the groove.

17. The exercising device of claim 16, further comprising:

a plurality of base pads, wherein the base pads are disposed under the base.

18. An exercising device, comprising:

a base;

a rail pivotally disposed at the base by at least one pivoting point, wherein the rail comprises two rail frames arranged at two sides of the base, respectively, and a number of the rail is limited to one;

a swinging chair movable along the rail for a linear movement relative to the base, wherein the swinging chair is pivotally connected to the rail by two sliders, a number of the sliders is limited to two, and each of the two sliders is connected to each of the rail frames;

a swinging unit disposed between the rail and the base, the swinging unit comprising an eccentric block to vibrate the rail; and an elastic unit disposed between the base and the rail;

wherein when the swinging chair is moved, a position of the swinging chair relative to a position of the base along a horizontal line is changed such that a force arm between the pivoting point and each of the sliders is changed and a vibrating amplitude of the swinging chair is changed correspondingly when the swinging chair is vibrated relative to the rail.

19. The exercising device of claim 18, wherein the elastic unit is a cylinder structure.

20. The exercising device of claim 18, further comprising:

a horizontal driving unit, comprising a motor driving the two sliders to move in the rail, thus the swinging chair being linked with the two sliders and moved along the rail.

21. The exercising device of claim 18, wherein the swinging unit comprises:

a roller rotatably disposed at the base, wherein the eccentric block sleeves on the roller and pushes the rail; and a wheel sleeved on the roller.

22. The exercising device of claim 18, further comprising:

a plurality of base pads, wherein the base pads are disposed under the base.

* * * * *